United States Patent [19]

Stoelzer

[11] Patent Number: 4,466,338

[45] Date of Patent: Aug. 21, 1984

[54] OBLIQUE-SHAFT AXIAL PISTON MACHINE HAVING A FOLLOWER PLATE FOR THE CYLINDER DRUM

[75] Inventor: Rainer Stoelzer, Elchingen, Fed. Rep. of Germany

[73] Assignee: Hydromatik GmbH, Elchingen, Fed. Rep. of Germany

[21] Appl. No.: 380,399

[22] Filed: May 20, 1982

[30] Foreign Application Priority Data

Jun. 26, 1981 [DE] Fed. Rep. of Germany ..... 3125264

[51] Int. Cl.[3] ..... F01B 13/04

[52] U.S. Cl. ..... 91/506

[58] Field of Search ..... 91/499, 504–506

[56] References Cited

U.S. PATENT DOCUMENTS

| | | | |
|---|---|---|---|
| 1,137,283 | 4/1915 | Pratt | 91/499 |
| 3,889,578 | 6/1975 | Clerk | 91/499 |
| 3,933,082 | 1/1976 | Molly | 91/499 |
| 3,943,828 | 3/1976 | Wagenseil | 91/499 |
| 4,108,048 | 8/1978 | Gauss | 91/499 |

FOREIGN PATENT DOCUMENTS

| | | | |
|---|---|---|---|
| 2619005 | 11/1977 | Fed. Rep. of Germany | 91/499 |
| 2307984 | 11/1976 | France | 91/499 |

*Primary Examiner*—William L. Freeh

*Attorney, Agent, or Firm*—Fitzpatrick, Cella, Harper & Scinto

[57] ABSTRACT

An axial piston machine of the oblique-shaft type is described. The transmission of torque between the drive disc and the cylinder drum of the machine is effected by direct propulsion of the cylinder drum by way of the piston elements traveling to and fro in cylinder bores of the cylinder drum. On the side of the cylinder drum towards the drive disc, a follower plate with slot-like openings is provided. The edges of the openings are met by the piston rod areas of the piston elements to drive the cylinder drum. In order that the follower plate may be light in construction and designed for long service life, it is proposed according to the invention, that the follower plate be made, by means of a locking part, into a follower disc having openings enclosed all around for passage of the piston rod area of the piston elements.

9 Claims, 4 Drawing Figures

OBLIQUE-SHAFT AXIAL PISTON MACHINE HAVING A FOLLOWER PLATE FOR THE CYLINDER DRUM

BACKGROUND OF THE INVENTION

1. Field of the Invention

This invention relates to an oblique-shaft axial piston machine having piston elements articulated in a drive disc fixedly connected to a drive shaft. The transmission of torque between the drive shaft, (which may be in the form of a drive disc), and a rotatably mounted cylinder drum supported on a rider and having axial cylinder bores in which the piston elements travel to and fro, is effected exclusively by piston rod portions of the piston elements. The piston elements, in at least one definite rotational position of the drive disc and cylinder drum, meet the edges of slot-like openings in a following plate connected to the cylinder drum. The width of these slot-like openings is somewhat less than the diameter of the cylinder bores.

2. Description of the Prior Art

In modern, compact axial piston machines of light-weight construction and incorporating oblique-shaft design, generally the cylinder drum is carried along directly by the piston rods, or by follower portions of piston elements, if the piston and piston rod take the form of a one-piece piston element.

In a known version of such a machine using direct propulsion of the cylinder drum, the piston rods, or follower areas of the piston elements, bear directly on the inside wall of the cylinder bores and thus transmit the requisite torque for turning the cylinder drum. A disadvantage of this approach is that the bearing takes place at the sealing surface of the cylinder bores. Since the propulsion by contact of the piston rods with the cylinder bores takes place only at definite rotational positions, and owing to the kinematic non-uniformity of the piston motion, concussions occur between the piston rod or piston element and the cylinder bore. In prolonged service of the machine, this may cause damage to the surface of the cylinder bore and hence impairment of the seal of the piston in the cylinder bore. In this connection, reference is made to German Public Disclosure Nos. DE-AS 2,262,026 and DE-AS 2,358,870.

In an oblique-shaft axial piston machine of the type referred to above and shown and described in U.S. Pat. No. 1,137,283, (corresponding to German Pat. No. 249,477), this hazard is avoided in that the cylinder drum is carried along by way of a separate follower plate, fixedly connected, however, to the cylinder. The follower plate is arranged on the side of the cylinder drum towards the drive disc. The follower plate takes the form of a star-shaped part having slot-like openings opening outward. The clear apertures of the openings are somewhat less than the diameter of the cylinder bores, but greater than that of the tapered piston rods, so that in a definite rotational position, the piston rods will meet an inner edge of the openings and propel the cylinder drum.

One-piece piston elements, as well as composite piston elements composed of a piston part and a piston rod, in modern axial piston machines, cannot be disassembled. This means that for installation of the follower plate, its openings must be radially accessible so that the piston elements or piston rods can be inserted. These radially accessible openings greatly weaken the follower plate, unless it is made so thick as to constitute an undesirably great additional weight, which must revolve together with the cylinder drum in operation of the machine. Given the long piston and piston rod service life attainable nowadays, the follower plate with radially accessible openings presents problems of strength.

It is an object of this invention to provide an improved follower plate of the type referred to above which is of light weight construction and which is capable of long service life in spite of the dynamic impact loads described above.

To achieve this object, in an oblique-shaft axial piston machine of the kind described above, it is proposed that the follower plate be fixedly connectable to a locking part that completes each opening to form a hole enclosed all around, so that the follower plate, together with the locking part, forms a stable follower disc. In one embodiment, the locking plate extends in the same plane as the follower plate and is of the same thickness. Thus, a stable follower disc results, which can be made comparatively thin, since the locking part, by closing the radially extending openings of the follower plate, stiffens the latter. Hence, the plate is substantially better able to transmit torque then the prior art star-shaped follower plate with radially extending openings.

In another embodiment of the invention, the locking part is in radially fixed, toothed engagement with the follower plate.

With the follower plate in the form of a more or less star-shaped part with openings opening radially outward, in a further embodiment, the locking part is an outer ring encircling the follower plate. Then the toothed engagement may be provided either by projections extending radially inward from the outer ring into recesses on the periphery of the follower plate, or by projections extending radially inward from the outer ring and fitting into the slot-like openings of the follower plate radially from without. Thus, mutual support of the flanks of the openings is provided, leading to an especially favorable design for transmission of torque by the follower disc.

With the follower plate in the form of an annular part with openings opening radially inward, the locking part, in another embodiment of the invention, takes the form of an inner ring. In this case toothed engagement is provided by projections extending radially outward from the inner ring and fitting into the openings of the follower plate radially from within. This too provides a follower plate of light-weight constructon for transmission of high torque.

BRIEF DESCRIPTION OF THE DRAWINGS

Several embodiments of the invention will be described in more detail below, by way of example, with reference to the accompanying drawings, in which.

Figure 2:
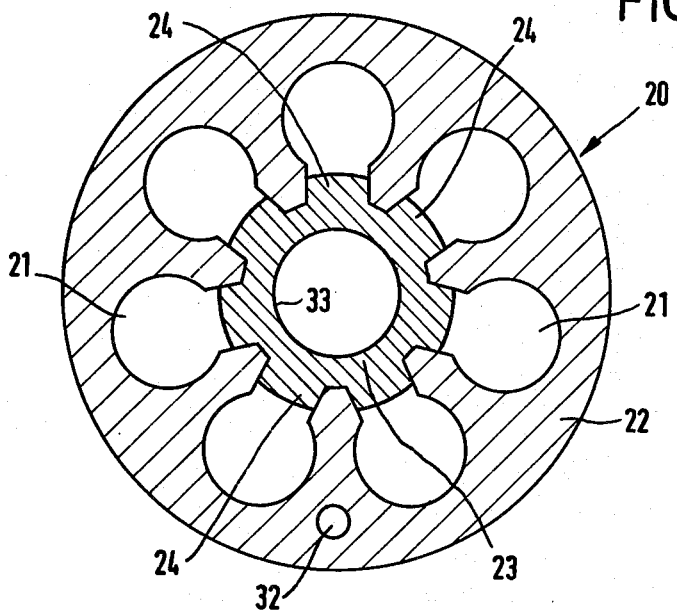
FIG. 2 is a plan view of a follower disc according to one embodiment of the invention.
Figure 3:
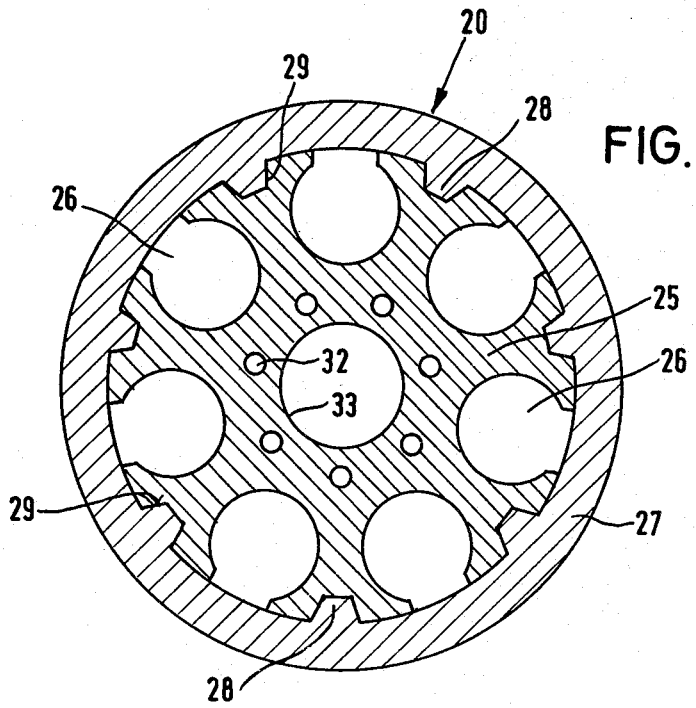
FIG. 3 is a plan view of a follower disc according to another embodiment of the invention.
Figure 4:
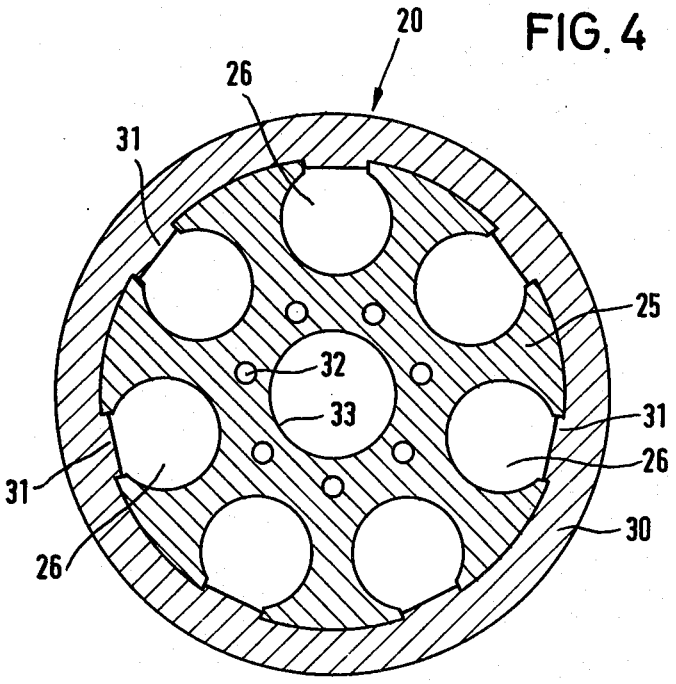
FIG. 4 is a plan view of a follower disc according to a third embodiment of the invention.

(The shading in FIGS. 2 to 4 does not indicate a cross-section but is merely intended to indicate the parts more clearly).

DETAILED DESCRIPTION OF THE PREFERRED EMBODIMENTS

Figure 1:
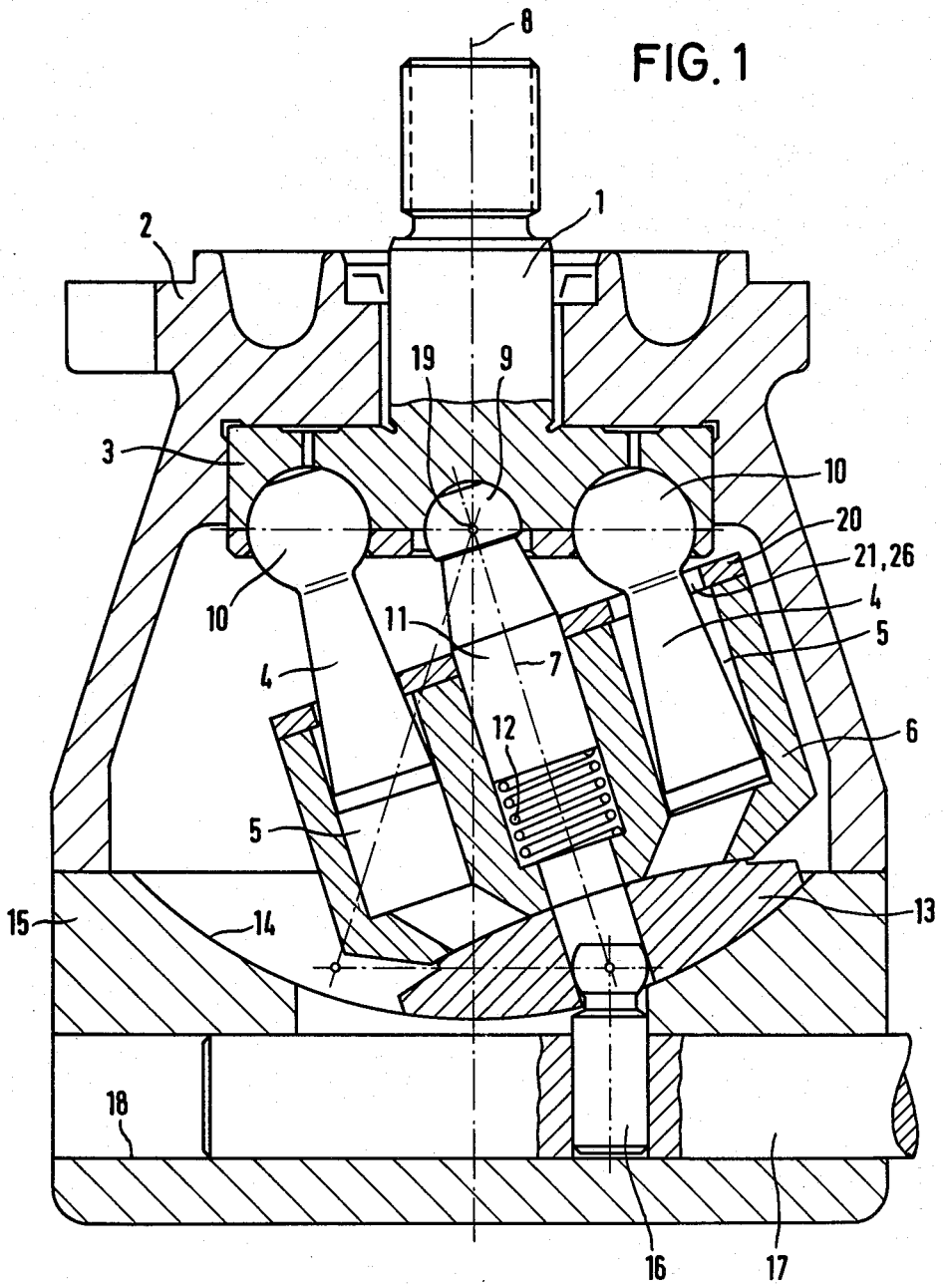
FIG. 1 is an elevational section view of axial piston machine according to this invention.

The axial piston machine shown in FIG. 1 has a drive shaft 1 mounted by ball bearings (not shown) in a housing 2, and integral with a drive disc 3. Piston elements 4 are articulated in ball-and-socket fashion with the drive disc 3 by way of ball members 10. The piston elements 4, as shown, are in one piece, but they may alternatively consist of pistons with piston rods articulated thereto, in which case the piston rods will bear the balls 10. The piston elements 4 travel in cylinder bores 5 of a cylinder drum 6. The cylinder drum 6 is set in rotation by the drive shaft 1 by way of the drive disc 3 and the piston elements 4. The stroke of the piston elements 4 depends on the oblique angle of the cylinder drum centerline 7 with respect to the axis of rotation 8 of the drive shaft 1. The cylinder drum 6 is centered by means of a central pin 11 seated in the drive disc 3 and supported on a rider 13, which in turn is supported on a cylindrical track guide 14 in the machine housing part 15. The cylinder drum 6 is supported under the action of hydraulic oil pressure in the loaded condition of the machine; and, in the unloaded condition of the machine, the cylinder drum is supported under the force of a compression spring 12 provided between the pin 11 and the drum. To vary the oblique angle of the centerline 7 of the cylinder drum 6 with respect to the axis 8 of the drive shaft 1, and hence to vary the displacement of the piston elements 4 in the cylinder bores 5, the rider 13 is acted upon by an adjusting pin 16 fixedly connected to an adjusting rod 17. The rod 17, in turn, is slidably mounted in a hole 18 through the machine housing 15. The rod 17 is acted upon by an adjusting mechanism (not shown) which displaces the rod 17 in its lengthwise direction, so that the pin 16 displaces the rider 13 to the cylindrical guide surface 14 of the housing 15 thereby to swing the cylinder drum 6 about an axis at 19. The rider 13 is provided with inlet and outlet passages ("kidney valves"), not seen in FIG. 1, which connect the cylinder bores 5 according to the rotational setting of the cylinder drum 6 at a given time to the respective inlet and outlet connections, likewise not shown, on housing part 15.

On the side of cylinder drum 6 towards the drive disc 3, a follower disc 20 is fixed, having openings 21 to admit the tapered piston rod portion of piston elements 4. According to the rotational position of drive disc and cylinder drum, a piston rod area will meet an inner edge of an opening 21 and thereby transmit torque from the drive disc 3 to the cylinder drum 6 and thus carry the latter along. The openings 21 are of lesser width than the diameter of the cylinder bores 5, so that the piston rod portions will each bear on the follower plate 20, and not on the cylinder bores 5.

Various forms of the follower plate 20 are represented in FIGS. 2 to 4. In the embodiment of FIG. 2, the follower disc 20 consists of a follower plate 22 with openings 21 extending radially inward and a locking part 23 in the form of an inner ring with projections 24 extending radially outward and fitting into the openings 21 opening radially inward.

In the embodiment of FIG. 3, the follower disc 20 consists of a follower plate 25 in the form of a star-shaped inner part with openings 26 extending radially outward and a locking part 27 consisting of an outer ring. This outer ring encloses the opening 26 from without. Projections 28 on the locking part 27, extend radially inward into matching recesses 29 in the follower plate 25 to provide a radially fixed toothed engagement between the follower plate 25 and the locking part 27.

The embodiment of FIG. 4 resembles that of FIG. 3 as to the form of the follower plate 25, and has accordingly been marked with the same reference numerals. In this case, the locking part 30 is in the form of an outer ring, with projections 31 extending radially inward and fitting into the openings 26 extending radially outward for rotationally fixed toothed engagement with the follower plate 25.

The follower plate and the locking parts of various types may be fastened to the cylinder drum 6 in suitable manner not shown in detail. They may, for example, be screw assembled. Screw holes for this purpose are indicated at 32. Also, the follower disc 20, composed of follower plate and locking part, is centered on the central pin 11 (FIG. 1) of the axial piston machine by means of a central bore 33 in the locking part 23 or the follower plate 26, as the case may be.

I claim:

1. An oblique-shaft axial piston machine having piston elements articulated in a drive disc fixedly connected to a drive shaft, in which the transmission of torque between / said drive shaft and a rotatably mounted cylinder drum, supported on a rider and having axial cylinder bores in which piston elements travel to and fro, is effected exclusively by piston rod portions of said piston elements which, in at least one definite rotational position of the drive shaft and cylinder drum, meet the edges of slot-like openings in a follower plate connected to the cylinder drum, the width of said openings being less than the diameter of the cylinder bores, said machine being characterized in that the follower plate is fixedly connectable to a locking part that completes each opening so as to form a hole enclosed all around, whereby the follower plate together with the locking part constitutes a stable follower disc.

2. An axial piston machine according to claim 1, characterized in that the locking part extends in the same plane as the follower plate, and is of the same thickness.

3. An axial piston machine according to claim 2, characterized in that the locking part is in rotationally fixed toothed engagement with the follower plate.

4. An axial piston machine according to claim 3, characterized in that the follower plate is in the form of a star-shaped part with openings opening radially outward and further characterized in that the locking part is in the form of an outer ring encircling the follower plate.

5. An axial piston machine according to claim 4, characterized in that said toothed engagement is provided by projections extending radially inward from the outer ring into recesses on the periphery of the follower plate.

6. An axial piston machine according to claim 4, characterized in that said toothed engagement is provided by projections extending radially inward from the outer ring and fitted into the openings of the follower plate radially from without.

7. An axial piston machine according to claim 3, characterized in that the follower plate is in the form of an annular part with openings opening radially inward and in that the locking part is in the form of an inner ring.

8. An axial piston machine according to claim 7, characterized in that said toothed engagement is provided by projections extending radially outward from the inner ring and fitted into the openings of the follower plate radially from within.

9. An axial piston machine according to claim 6 or 8 characterized in that the openings of the follower plate are slot-like.

* * * * *